United States Patent [19]

Flaherty

[11] 4,198,267

[45] Apr. 15, 1980

[54] IMPROVED PULP SHEET FORMATION

[75] Inventor: Edwin H. Flaherty, Pointe Claire, Canada

[73] Assignee: Dorset Industrial Chemicals Ltd., Chateauguay, Canada

[21] Appl. No.: 868,519

[22] Filed: Jan. 11, 1978

[51] Int. Cl.[2] ..... D21H 3/00

[52] U.S. Cl. ..... 162/158; 162/172; 162/173; 162/179; 162/181 C; 252/358

[58] Field of Search ..... 162/173, 181 C, 181 R, 162/70, 179, 172, 158; 252/358, 321

[56] References Cited

U.S. PATENT DOCUMENTS

| | | | |
|---|---|---|---|
| 3,528,929 | 9/1970 | Buckman et al. | 252/358 |
| 3,639,260 | 2/1972 | Michalski | 252/358 |
| 3,697,442 | 10/1972 | Lieberman | 252/358 |
| 3,705,860 | 12/1972 | Duvall | 252/358 |
| 4,021,365 | 5/1977 | Sinka et al. | 252/358 |

OTHER PUBLICATIONS

Hackh's "Chemical Dictionary" (1969) p. 488.
Casey "Pulp & Paper" vol. II (1960) pp. 765–768.

*Primary Examiner*—S. Leon Bashore
*Assistant Examiner*—Peter Chin
*Attorney, Agent, or Firm*—Sim & McBurney

[57] ABSTRACT

The drainage of pulp sheet is improved by treatment of the pulp prior to entry to the sheet making machine with a composition comprising a suspension of finely-divided hydrophobic lubricating particles in a suitable carrier liquid. The invention has particular applicability to paper making wherein the smoothness and printability of the paper is improved and to pulp drying.

2 Claims, 2 Drawing Figures

IMPROVED PULP SHEET FORMATION

FIELD OF INVENTION

The present invention relates to pulp sheet making.

BACKGROUND TO THE INVENTION

In certain pulp mill operations, a slurry of pulp is formed into a mat or sheet of fibres and dewatered. Such sheet formation is effected in paper making and in pulp drying operations.

SUMMARY OF INVENTION

It has been surprisingly found that sheet formation can be improved by treatment of the pulp slurry prior to sheet formation with a composition comprising a suspension of finely-divided hydrophobic lubricating particles in a suitable carrier liquid.

GENERAL DESCRIPTION OF INVENTION

Figure 1:
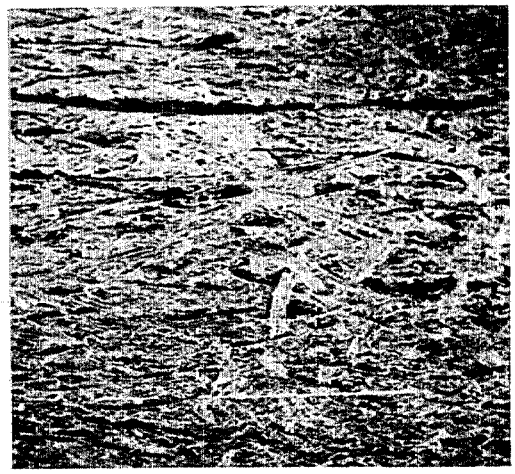
FIGS. 1 and 2 are electron micrographs of paper sheets in a newsprint machine before and after treatment utilizing the process of the present invention.

The addition of the composition to the pulp slurry results in improved drainage of the pulp sheet as it is formed. The improved formation results in superior paper sheet properties when the pulp sheet is formed in a paper making machine and in increased dried pulp production when the pulp sheet is formed in a pulp drying machine.

While it is not intended to be limited thereto, it is believed that the superior results obtained using the invention result from a reduction of friction and static electricity on the surface of the pulp sheet being formed with consequent dispersion of pulp agglomerates.

The composition which is applied to the pulp fibres essentially comprises a suspension of finely-divided hydrophobic lubricating particles in a carrier liquid. The carrier liquid may be any convenient hydrocarbon oil.

The liquid hydrocarbon oil may be any inert liquid aliphatic, alicyclic or aromatic hydrocarbon or mixture thereof. The hydrocarbon should be liquid at room temperature and atmospheric pressure, have a viscosity of from about 30 to about 400 SUS at 100° F. and an average of from about 6 to about 25 carbon atoms.

The finely-divided hydrophobic lubricating particles may include hydrophobic silica particles, hydrophobic oil-insoluble wax particles, or mixtures of the two. Such hydrophobic silica particles usually are precipitated silica particles which have the surface rendered hydrophobic by the use of an oil or other hydrophobic material, such as, a suitable silicone.

The hydrophobic oil-insoluble wax particles usually are waxy fatty acid amide particles, generally those formed by reaction of a polyamine containing at least one alkylene group having from 2 to 6 carbon atoms and a fatty acid having from five to twenty-two carbon atoms excluding the carboxyl group carbon.

Among the fatty acids which may be used are hexanoic, decanoic, lauric, palmitic, oleic, stearic, ricinoleic, naphthenic acids obtained as by-products from the refining of petroleum, tall oil acids and tallow fatty acids.

Polyamines which may be used include ethylene diamine, butylene diamine, diethylene triamine, triethylene tetramine, hexamethylene diamine, decamethylene diamine, hydroxyethyl ethylene diamine and 1:3-diamino-2-propanol.

Examples of suitable hydrophobic amides are methylene bis acrylamide, methylene bis pelargonamide, ethylene bis capramide, methylene bis lauramide, methylene bis myristamide, methylene bis palmitamide, methylene bis stearamide, ethylene bis arachidamide and ethylene bis behenamide.

It is preferred to use mixtures of hydrophobic silica particles and hydrophobic amide particles as the finely-divided hydrophobic lubricating particles. The weight ratio of the components of such mixtures may vary widely, such as, from about 1:9 to about 9:1, typically about 1:1.

The particle size of the finely-divided particles in the composition may vary widely and is colloidal in magnitude. The particle size is generally less than about 20 microns, preferably less than about 10 microns. There is usually a range of particle sizes in the composition.

The proportions of the components of the composition may vary widely although the content of finely-divided hydrophobic particulate material generally does not exceed about 25% by weight of the composition, and quantities as low as about 1% by weight may be used. Preferably, the hydrophobic particles constitute about 5 to about 15% by weight of the composition.

The composition may optionally contain minor quantities of other components. One such additional component is a spreading agent which may be one or more anionic, cationic or non-ionic surfactant.

Examples of suitable anionic surfactants are fatty acids containing from about 12 to about 22 carbon atoms, soaps of the fatty acids, alkali metal salts of alkylaryl sulfonic acids, sulfated, or sulfonated oils and alkali metal salts of short chain petroleum sulfonic acids.

Examples of suitable cationic surfactants are salts of long chain primary, secondary or tertiary amines and quaternary salts.

Examples of suitable non-ionic surfactants are alkoxylated higher fatty alcohols, alkoxylated alkyl phenols, alkoxylated fatty acid amines, polyethylene glycol esters of long chain fatty acids, sorbitans, Spans and Tweens.

The spreading agent assists in the spreading of the carrier in the aqueous slurry and hence in the distribution and penetration of the lubricating particles into the slurry.

The quantity of spreading agent used may vary widely, and is generally less than about 7% by weight of the composition, preferably in the range of about 1 to about 2% by weight of the composition.

Another minor component which may be included in the composition is a silicone oil, which may be a polysiloxane, for example, a dimethyl polysiloxane. When present, small quantities of silicone oil of less than about 2% by weight are used, preferably about 0.1 to about 1% by weight.

Another minor component which may be present is a colloidal or fumed silica which acts as a thickening agent for the composition. Such silica may be present in quantities up to about 5% by weight, preferably about 0.05 to about 0.5% by weight.

An alcohol also may be included in the composition to act as a stabilizer. The alcohols which may be used include short chain aliphatic alcohols, for example, isopropyl alcohol. Quantities of such alcohol may vary up to about 3% by weight and preferably are in the range of about 0.5 to about 1% by weight.

One further minor component which may be present in the composition is a fatty acid ester which functions as a dispersing agent and viscosity cutter. This component may be any fatty acid ester of a long chain fatty acid, such as, a fatty acid having about 5 to about 22 carbon atoms in the chain, and a lower alcohol, such as one having from 1 to 6 carbon atoms. The fatty acid ester may be present in the composition in an amount of up to about 3% by weight of the composition, preferably about 0.1 to about 1% by weight.

The composition which is used in this invention, therefore, comprises the following essential and optional components in the following proportions by weight: Finely-divided Hydrophobic particles

| | |
|---|---|
| - general range | about 1 to about 25% |
| - preferred range | about 5 to about 15% |
| Hydrocarbon oil | |
| - general range | about 75 to about 99% |
| - preferred range | about 85 to about 95% |
| Spreading agent | |
| - general range | 0 to about 7% |
| - preferred range | about 1 to about 2% |
| Silicone oil | |
| - general range | 0 to about 2% |
| - preferred range | about 0.1 to about 1% |
| Silica | |
| - general range | 0 to about 5% |
| - preferred range | about 0.05 to about 0.5% |
| Alcohol | |
| - general range | 0 to about 3% |
| - preferred range | about 0.5 to about 1% |
| Fatty acid ester | |
| - general range | 0 to about 3% |
| - preferred range | about 0.1 to about 1% |

Where the preferred embodiment of the invention wherein hydrophobic silica particles and hydrophobic amide particles are utilized, it is preferred to make up separate compositions, one containing the hydrophobic silica and the other containing the hydrophobic amide particles, and mix the two compositions together in the desired proportions.

The following are the general and preferred ranges of components in % by weight in such separate compositions:

| | | |
|---|---|---|
| A. (1) | Hydrophobic Silica | |
| | - general range | about 1 to about 25 |
| | - preferred range | about 6 to about 15 |
| (2) | Hydrocarbon oil | |
| | - general range | about 75 to about 99 |
| | - preferred range | about 82 to about 88 |
| B. (1) | Hydrophobic Amide | |
| | - general range | about 2 to about 18 |
| | - preferred range | about 6 to about 10 |
| (2) | Hydrocarbon oil | |
| | - general range | about 72 to about 98 |
| | - preferred range | about 85 to about 90 |

The following are the general and preferred ranges of components in % by weight, including minor components, in such separate compositions:

| | |
|---|---|
| Component A | |
| Hydrophobic silica | |
| - general range | about 1 to about 25 |
| - preferred range | about 6 to about 15 |

-continued

| | |
|---|---|
| Hydrocarbon oil | |
| - general range | about 75 to about 99 |
| - preferred range | about 82 to about 88 |
| Surfactant | |
| - general range | 0 to about 7 |
| - preferred range | about 1 to about 2 |
| Fumed silica | |
| - general range | 0 to about 5 |
| - preferred range | about 0.1 to about 0.5 |
| Component B | |
| Hydrophobic amide | |
| - general range | about 2 to about 18 |
| - preferred range | about 6 to about 10 |
| Hydrocarbon oil | |
| - general range | about 72 to about 98 |
| - preferred range | about 85 to about 90 |
| Silicone oil | |
| - general range | 0 to about 5 |
| - preferred range | about 1 to about 2 |
| Alcohol | |
| - general range | 0 to about 5 |
| - preferred range | about 1.5 to about 3 |
| Surfactant | |
| - general range | about 0.5 to about 5 |
| - preferred range | about 1 to about 2 |
| Fatty acid esters | |
| - general range | about 0.5 to about 6 |
| - preferred range | about 1 to about 3 |

The ingredients of the composition are mixed together to provide a uniform dispersion of the insoluble components in the soluble components. The composition is used to treat the paper sheet to obtain superior results.

In one embodiment of this invention, the composition is added to the pulp slurry immediately prior to entry into a paper making machine. Paper sheet resulting from the machine exhibits an improved smoothness and decreased linting, as compared with sheet formed on the machine in the absence of the composition. Improved smoothness and decreased linting of the sheet are important in many paper applications, such as, newsprint, since better printing impressions are obtained and improved printing machine runability is experienced, especially with the newer printing presses with shallow printing plates.

In another embodiment of the invention, the composition is added to the pulp slurry immediately prior to entry into a pulp drying machine. The increased drainage results in a higher density sheet and increased dried pulp production.

The quantity of the composition which is used in the process of the invention may vary widely depending on the pulp stock and the components of the composition, such as, up to about 20 pounds per ton of pulp, and typically about 1 to 2 pounds per ton of pulp.

The invention is applicable to a wide variety of wood pulps, such as, bleached or unbleached sulfite pulp, kraft pulp and/or groundwood or other mechanical, and mixtures thereof, pulp. The invention has particular applicability to the formation of newsprint sheet, where further processing of the sheet after formation generally is not carried out, and hence smoothness and printability of the sheet are particularly important.

The invention is illustrated by the following Examples:

EXAMPLE 1

A composition was formed by mixing until homogenized component A and component B in the proportions of $\frac{2}{3}$ by weight of component A and $\frac{1}{3}$rd by weight of component B, and passing the mixture through a Sonalator. Components A and B were as follows:

| Component A Ingredient | % by weight | Component B Ingredient | % by weight |
|---|---|---|---|
| Hydrophobic Quso G30[1] | 12.9 | Dorset Wax[6] | 6.5 |
| Tergitol NPX[2] | 1.0 | Surchem 201[7] | 0.5 |
| Cab-O-Sil[3] | 0.3 | Silicone | 0.5 |
| Polyglycol 1200[4] | 0.1 | Isopropyl alcohol | 1.75 |
| Mentor 29[5] | 85.7 | Methyl oleate | 2.0 |
| | | Tergitol NPX[2] | 0.5 |
| | | Process oil[8] | 89.25 |

Notes:
[1]Hydrophobic Quso G30 is a finely-divided precipitated silica which has been rendered hydrophobic by reaction with a silicone oil.
[2]Tergitol NPX is a non-ionic surfactant which is a nonyl phenyl polyethylene glycol ether.
[3]Cab-O-Sil is a precipitated very fine fumed silica.
[4]Polyglycol 1200 is a polyglycol having a molecular weight of about 1200.
[5]Mentor 29 is a light colored paraffinic base oil.
[6]Dorset Wax is ethylene bis stearamide wax.
[7]Surchem 201 is a calcium petroleum sulfonate.
[8]Process Oil is a well refined paraffinic oil.

Figure 2:
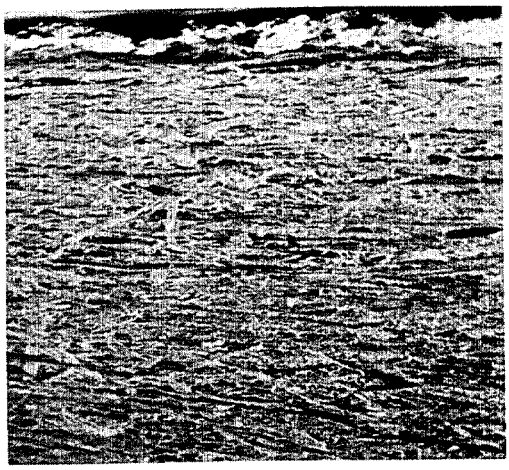

The resulting mixture was introduced to pulp slurry entering a newsprint machine in a quantity of about 2 lbs./ton of pulp. Electron micrographs were taken of the resulting paper sheet and compared with similar micrographs taken of sheet formed in conventional manner. Two of the micrographs appear as FIGS. 1 and 2 and a clear improvement in smoothness can be seen for the treated sheet (FIG. 2).

EXAMPLE 2

Samples of the composition outlined in Example 1 were introduced to bleached hardwood Kraft pulp slurry entering a pulp drying machine in a quantity of about 2 lbs./ton of pulp. Drainage was found to increase as compared with absence of the composition, as evidenced by the necessity to add further stock to maintain the machine speed. The basic weight of the dryer was about 800 initially and increased to over 900 with the addition of the composition.

SUMMARY

The present invention, therefore, provides an improved pulp sheet formation procedure which has considerable utility. Modifications are possible within the scope of this invention.

What I claim is:

1. In a method of forming a pulp sheet from an aqueous slurry of cellulosic fibrous material fibres, the improvement which comprises introducing to said slurry immediately prior to said sheet formation a composition in an amount effective to improve the formation of said paper sheet as formed, said composition being formed by mixing two separate mixtures A and B of the following compositions in the weight proportion of about 9:1 to about 1:9:

| | | |
|---|---|---|
| Mixture A | hydrophobic silica | about 6 to about 15% by weight |
| | hydrocarbon oil | about 82 to about 88% by weight |
| | surfactant selected from the group consisting of anionic, cationic and non-ionic surfactants | about 1 to about 2% by weight |
| | fumed silica | about 0.1 to about 0.5% by weight |
| Mixture B | hydrophobic amide wax | about 6 to about 10% by weight |
| | hydrocarbon oil | about 85 to about 90% by weight |
| | silicone oil | about 1 to about 2% by weight |
| | short chain aliphatic alcohol | about 1.5 to about 3% by weight |
| | fatty acid ester of a long chain fatty acid and a lower alcohol | about 1 to about 3% by weight |
| | surfactant other than said silicone oil, short chain aliphatic alcohol and fatty acid ester of a long chain fatty acid and a lower alcohol and selected from the group consisting of anionic, cationic and non-ionic surfactants. | about 1 to about 2% by weight |

2. A composition for improving the formation of a pulp sheet from an aqueous slurry of cellulosic material fibres which is formed by mixing two separate mixtures A and B of the following compositions in the weight proportion of about 9:1 to about 1:9:

| | | |
|---|---|---|
| Mixture A | hydrophobic silica | about 6 to about 15% by weight |
| | hydrocarbon oil | about 82 to about 88% by weight |
| | surfactant selected from the group consisting of anionic, cationic and non-ionic surfactants | about 1 to about 2% by weight |
| | fumed silica | about 0.1 to about 0.5% by weight |
| Mixture B | hydrophobic amide wax | about 6 to about 10% by weight |
| | hydrocarbon oil | about 85 to about 90% by weight |
| | silicone oil | about 1 to about 2% by weight |
| | short chain aliphatic alcohol | about 1.5 to about 3% by weight |
| | fatty acid ester of a long chain fatty acid and a lower alcohol | about 1 to about 3% by weight |
| | surfactant other than said silicone oil, short chain aliphatic alcohol and fatty acid ester of a long chain fatty acid and a lower alcohol and selected from the group consisting of anionic, cationic and non-ionic surfactants. | about 1 to about 2% by weight |

* * * * *